United States Patent [19]

Catanese et al.

[11] 4,327,611

[45] May 4, 1982

[54] ADJUSTABLE SLEEVE FLEX WRENCH

[76] Inventors: Salvatore S. Catanese, 25 Almount Rd., Fitchburg, Mass. 01420; Carmine A. Marchetti, 63 Pierce St., Leominster, Mass. 01453

[21] Appl. No.: 176,992

[22] Filed: Aug. 11, 1980

[51] Int. Cl.[3] ..... B25G 1/12

[52] U.S. Cl. ..... 81/177.9; 403/158

[58] Field of Search ..... 81/177 PP, 177.8, 177.9; 403/54, 55, 83, 119, 157, 158

[56] References Cited

U.S. PATENT DOCUMENTS

| | | | |
|---|---|---|---|
| 1,169,496 | 1/1916 | Knauff | 81/177 PP X |
| 1,286,161 | 11/1918 | Wagner | 81/177 PP X |
| 3,186,265 | 6/1965 | Wenturine et al. | 81/177.9 |
| 4,084,456 | 4/1978 | Pasbrig | 81/177.8 |

*Primary Examiner*—James G. Smith

*Attorney, Agent, or Firm*—Charles R. Fay

[57] ABSTRACT

A double end wrench having an elongated handle with a pivoted wrench head at each end, and a sliding sleeve which may be positioned to leave both wrench heads unaffected or may be slid to one end or the other of the wrench to lock the respective head in position, so that each wrench head is angularly adjustable.

2 Claims, 3 Drawing Figures

ADJUSTABLE SLEEVE FLEX WRENCH

BACKGROUND OF THE INVENTION

There are many instances where nuts are in a position difficult to get at with the ordinary wrench, and it is the purpose of the present invention to provide a wrench which has a wrench head at each end, these wrench heads being capable of being angularly adjustable with respect to a connecting handle so that practically any angle of approach to a nut is possible.

SUMMARY OF THE INVENTION

The present adjustable sleeve flex wrench comprises an elongated handle having a wrench head at each end thereof. These heads may be box-type heads or open end or any other variation desired. Each wrench head is mounted at its respective end of the handle on a pivot pin which extends across the handle at right angles to the longitudinal axis thereof. Each wrench head is pivotable on its pin and is provided with interlocking means to maintain it in the angular position to which it has been adjusted. The sleeve may be positioned centrally on the handle, in which case both of the heads are adjustable or it may be located to immobilize either wrench head which will then lie in a coplanar relationship with the handle and the other wrench head can be adjusted.

BRIEF DESCRIPTION OF THE DRAWINGS

FTG. 1 is a perspective view illustrating the invention.

PREFERRED EMBODIMENT OF THE INVENTION

Figures 1, 2, 3:
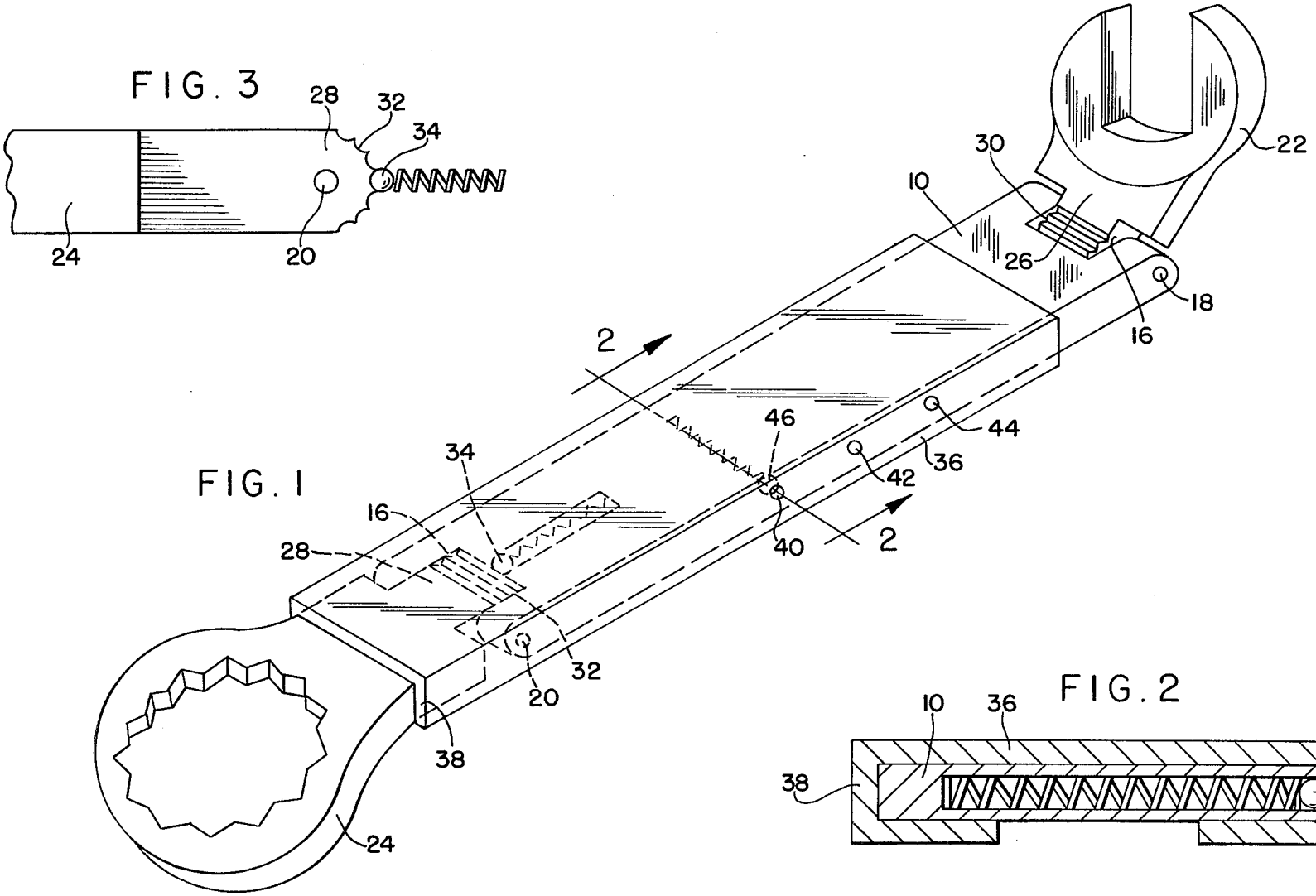
FIG. 2 is a section on line 2—2 of FIG. 1.
FIG. 3 is a diagrammatic view illustrating the locking action with respect to the wrench heads.

In this case an elongated handle 10 is shown as having a rectangular section. At each end there is a central recess 16. Pivot pin 18 is located transversely of the handle 10 and adjacent one end thereof, and extends through a recess 16. At the opposite end of the handle a similar pin 20 extends through the recess 16 there.

The pivot pins 18 and 20 pivotally mount the wrench heads 22 and 24 respectively. The illustration does not limit the kind or size of wrench head that may be used. Any known type may be utilized for the purposes of this invention. However, these wrench heads are provided with central extending portions 26 and 28 which have transverse grooves as at 30 and 32. These grooves are located on arcs. Each extending portion 26 and 28 has a cooperative spring loaded ball as at 34, only one being shown in the present case. (See particularly FIG. 3) The construction as to these members is the same at each end of the wrench regardless of the kind of wrench head that is being used, and the balls serve to yieldingly latch the respective wrench head in its angularly adjusted position, see wrench head 22. The head 24 is located in a straight locked position coplanar with handle 10.

A rectangular sleeve 36 is slidably mounted on handle 10 and it is provided with flanges 38 in which there are three holes as at 40, 42, and 44. A spring loaded ball 46 similar to that at 34 is provided to cooperate with a selected one of these holes so as to lock the wrench head at one end as shown in FIG. 1, or selectively at the opposite end, or it may have a central location where both ends are free. In this case the ball 46 engages in central hole 42.

Either head 22 or 24 can be locked in coplanar relation with handle 10 or located in angularly adjusted latched position.

If the sleeve 36 be made a little longer, it is possible to position it to lock both heads at once.

We claim:

1. A wrench comprising an elongated handle, a wrench head at one end thereof, a transverse pivot pin in said handle, a recess in the handle at an end thereof, said pin extending through the recess, the wrench head including an extending portion fitting into the recess, the pin extending therethrough, so that the wrench head is angularly adjustable with respect to the handle on an axis transverse to the length of the handle, means yieldingly latching the wrench head in its adjusted position, a sleeve mounted to slide on said handle, said sleeve being adapted to be located in at least two positions in one of which the wrench head is free and in the other position the sleeve partly encompasses the extending portion of the wrench head and the handle and holds the wrench head immobile in prolongation of the wrench handle, a second wrench head at the opposite end of the handle, a second pivot pin therefor, a second recess, a second extending portion on the second-named wrench head, the second-named pin extending into the second recess and through the second extending portion, and means for yieldingly latching the second-named wrench head in angularly adjusted position with respect to the handle when the sleeve is positioned so as to expose the entire second wrench head and its extending portion, said sleeve being of a length to free one wrench head while holding the other wrench head immobile.

2. The wrench of claim 1 including means to yieldingly latch the sleeve in its slidable selected position uncovering either wrench head, or latching the same in locked position of either wrench head.

* * * * *